US007695319B1

(12) United States Patent
Yang et al.

(10) Patent No.: US 7,695,319 B1
(45) Date of Patent: Apr. 13, 2010

(54) ELECTRICAL CONNECTOR HAVING A SHIELD CASE WITH ELASTIC LOCKING PIECES

(75) Inventors: Chih-Lin Yang, Tu-Cheng (TW); Hsin-Tsung Ho, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/485,045

(22) Filed: Jun. 16, 2009

(51) Int. Cl.
*H01R 13/648* (2006.01)

(52) U.S. Cl. ..... 439/607.37; 439/903

(58) Field of Classification Search ..... 439/607.35, 439/607.37, 607.4, 607.54, 903, 607.01
See application file for complete search history.

(56) References Cited

U.S. PATENT DOCUMENTS 7,198,522 B1 * 4/2007 Ho et al. ..... 439/660
7,214,096 B2 * 5/2007 Huang et al. ..... 439/607.01
7,442,066 B1 * 10/2008 Ho et al. ..... 439/358
2006/0148300 A1 * 7/2006 Huang et al. ..... 439/353

* cited by examiner

*Primary Examiner*—Javaid Nasri

(57) ABSTRACT

An electrical connector includes an insulating housing and a shield case for enclosing the insulating housing. The insulating housing includes a base section of which two opposite side surfaces respectively define a groove and a recess. The groove penetrates a front edge of the corresponding side surface and slants outward gradually from a front edge to a rear edge. The recess is located in rear of the groove, with a small space from the rear edge of the groove. The shield case includes two opposite side walls attached to the corresponding side surfaces of the base section, a cut portion formed in two substantially corresponding portions of both of the side walls, an elastic locking piece extending frontward and inclining inward from a rear edge of the cut portion. When the electrical connector is assembled, a free end of the elastic locking piece slides along the corresponding groove and is gradually compressed outward and finally secured into the corresponding recess by means of release thereof.

5 Claims, 7 Drawing Sheets

ELECTRICAL CONNECTOR HAVING A SHIELD CASE WITH ELASTIC LOCKING PIECES

BACKGROUND OF THE INVENTION

1. Field of the Invention

The present invention relates to an electrical connector, and more particularly to a mini-USB type electrical connector having a shield case with elastic locking pieces for being locked to an outside of an insulating housing thereof.

2. The Related Art

Referring to FIG. 8, an electrical connector 100' includes an insulating housing 10', a conductor assembly 30' holding in the insulating housing 10', and a shield case 20' for enclosing the insulating housing 10'. The insulating housing 10' has a base section 11' with a groove 111' is defined in each of two opposing sides thereof. The shield case 20' includes a top wall 21', a bottom wall 22' and two side walls 23' connecting with the top wall 21' and the bottom wall 22'. Two elastic locking pieces 231' extend downward respectively from both of the side walls 23' and are positioned into the corresponding grooves 111' of the insulating housing 10'.

However, the elastic locking piece 231' needs to bend downward for positioning into the corresponding groove 111' when the mentioned electrical connector 100' is assembled. Therefore, the process of this assembly is not only complex, but also easy to make the insulating housing 10' scratch.

SUMMARY OF THE INVENTION

It is an object of the present invention to provide an electrical connector capable of being easily assembled and to avoiding scratching the insulating housing in the process of assembly.

In order to achieve foregoing objective, the electrical connector includes an insulating housing and a shield case for enclosing the insulating housing. The insulating housing includes a base section of which two opposite side surfaces respectively define a groove and a recess. The groove penetrates a front edge of the corresponding side surface and slants outward gradually from a front edge to a rear edge. The recess is located in rear of the groove, with a small space from the rear edge of the groove. The shield case includes two opposite side walls attached to the corresponding side surfaces of the base section, a cut portion formed in two substantially corresponding portions of both of the side walls, an elastic locking piece extending frontward and inclining inward from a rear edge of the cut portion.

As the above description, because the groove is formed with a inclined bottom, a free end of the elastic locking piece could slide along the corresponding groove when the electrical connector is assembled and finally secured into the recess by means of release thereof. Therefore, the electrical connector can be easily assembled and also prevent the insulating housing from scratching in the process of assembly.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
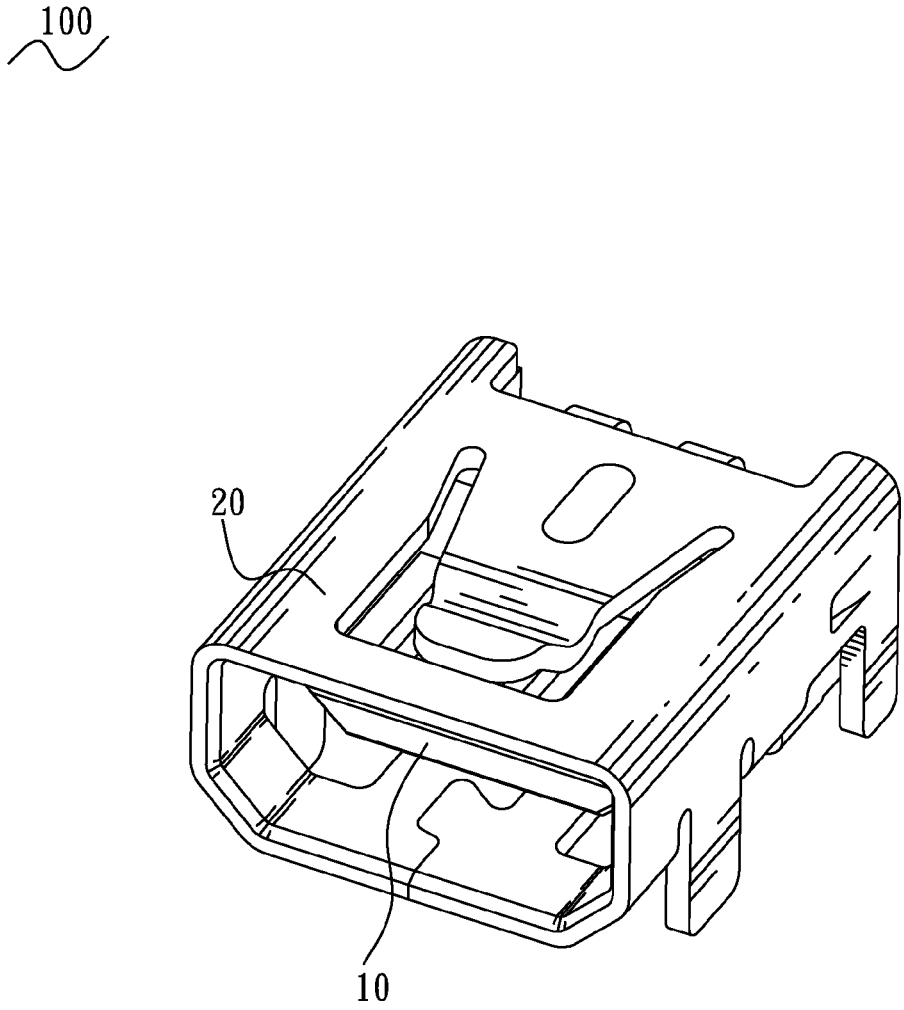
FIG. 1 is a perspective view of an electrical connector in accordance with the present invention.
Figure 2:
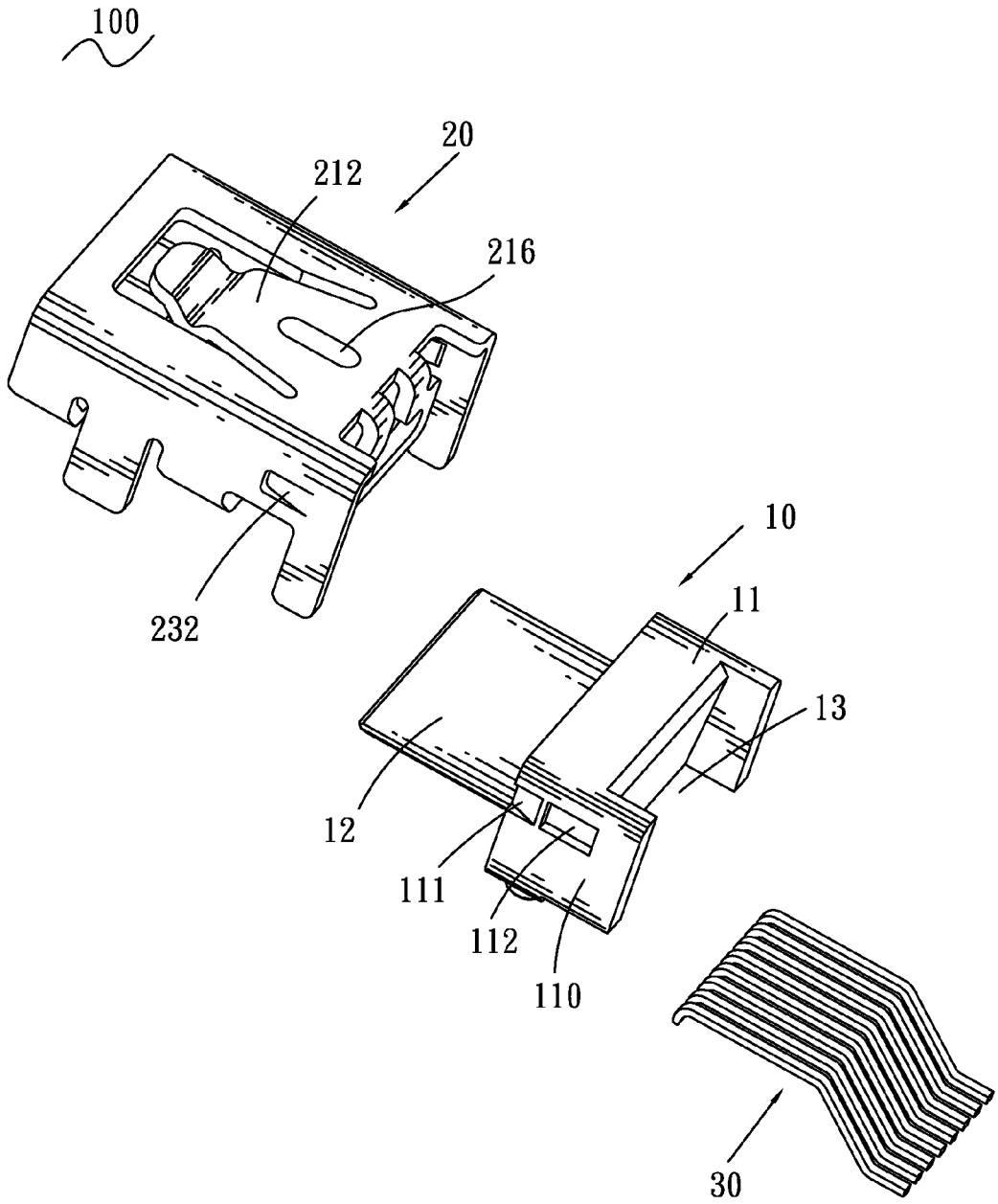
FIG. 2 is an exploded view of the electrical connector.

Referring to FIGS. 1 and 2, the electrical connector 100 in accordance with the present invention is formed with an insulating housing 10 in which a conductor assembly 30 is fixed by insert molding and a shield case 20 enclosing the insulating housing 10.

Figure 3:
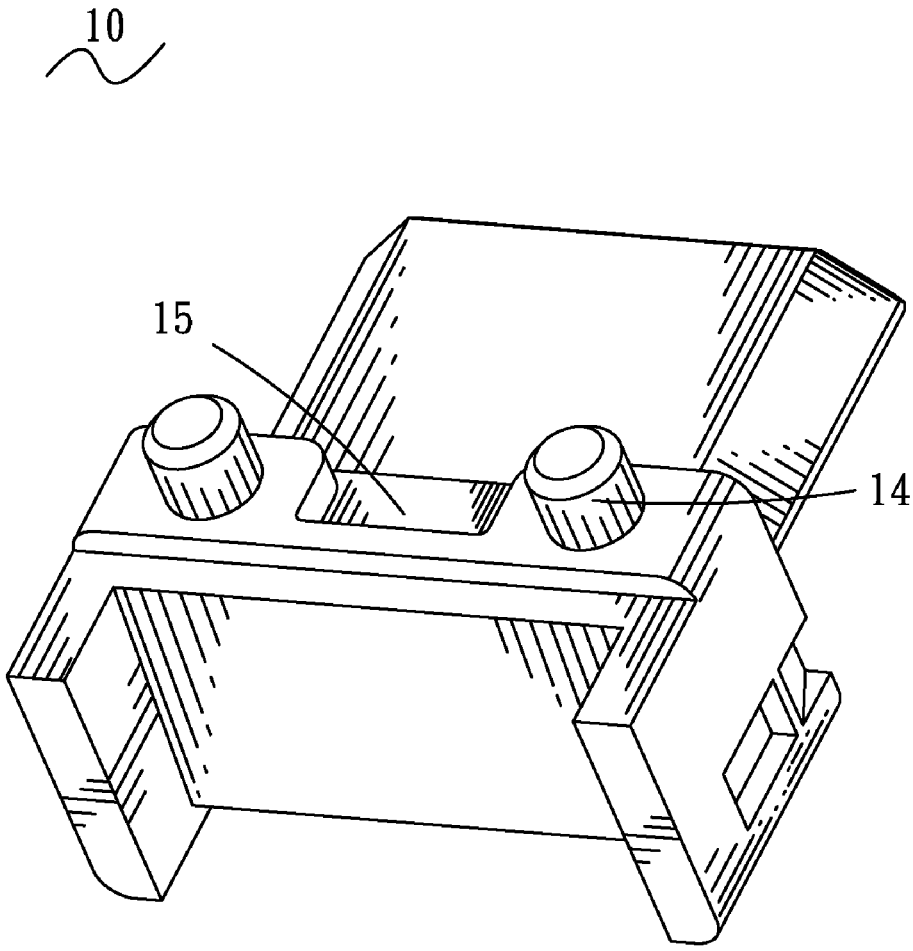
FIG. 3 is a perspective view of an insulating housing of the electrical connector.

With referring to FIGS. 2 and 3, the insulating housing 10 includes a base section 11 and a mating section 12 configured as a rectangle plate extending forward from a middle portion of the base section 11. The base section 11 includes an indentation 13 at a rear thereof. A bottom of the base section 11 has a gap 15 penetrating a front thereof and a column engagement portion 14 protruding respectively from two sides of the gap 15. The base section 11 further includes two opposite side surfaces 110 which respectively define a groove 111 and a recess 112. The groove 111 penetrates a front edge of the corresponding side surface 110 and slants outward gradually from a front edge to a rear edge thereof. The recess 112 is located in rear of the groove 111, with a small space from the rear edge of the groove 111.

Figure 4:
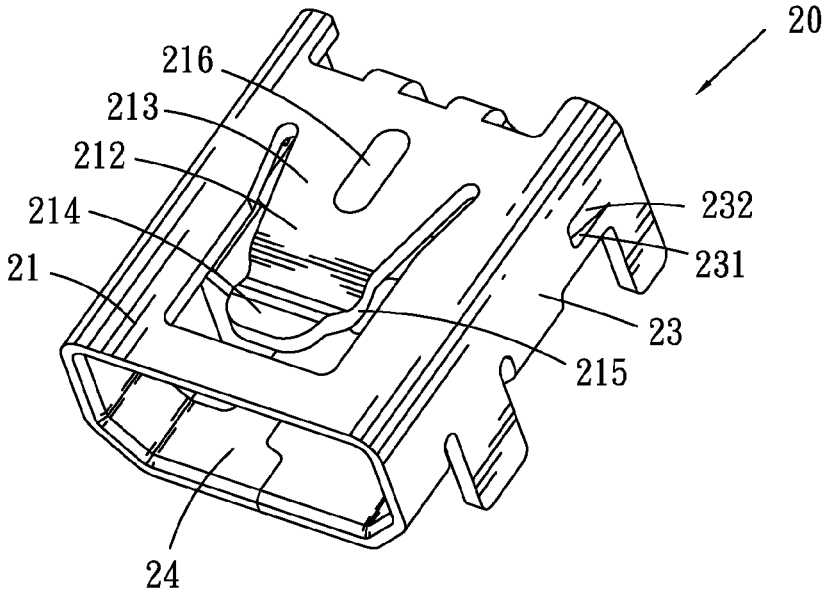
FIG. 4 is a perspective view of a shield case of the electrical connector.
Figure 5:
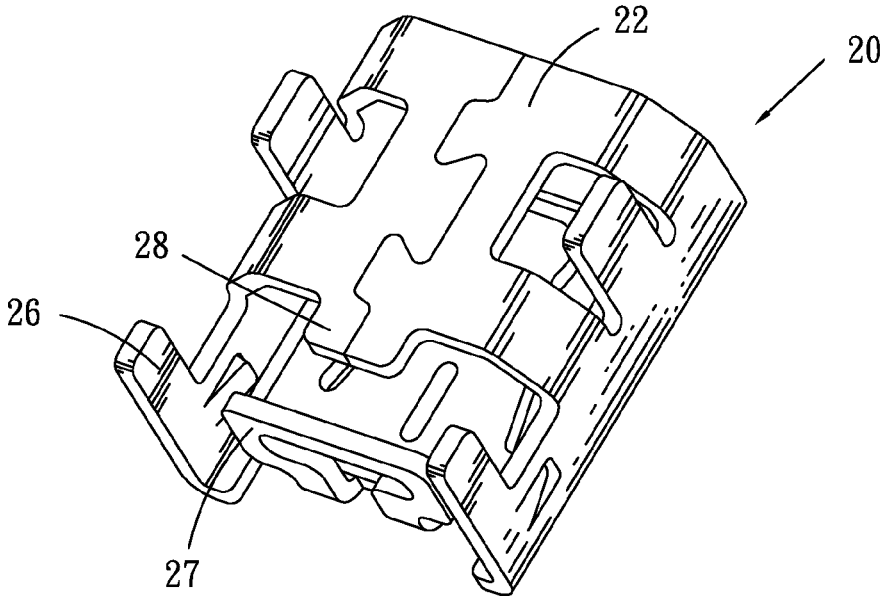
FIG. 5 is another angle perspective view of the shield case of the electrical connector.
Figure 7:
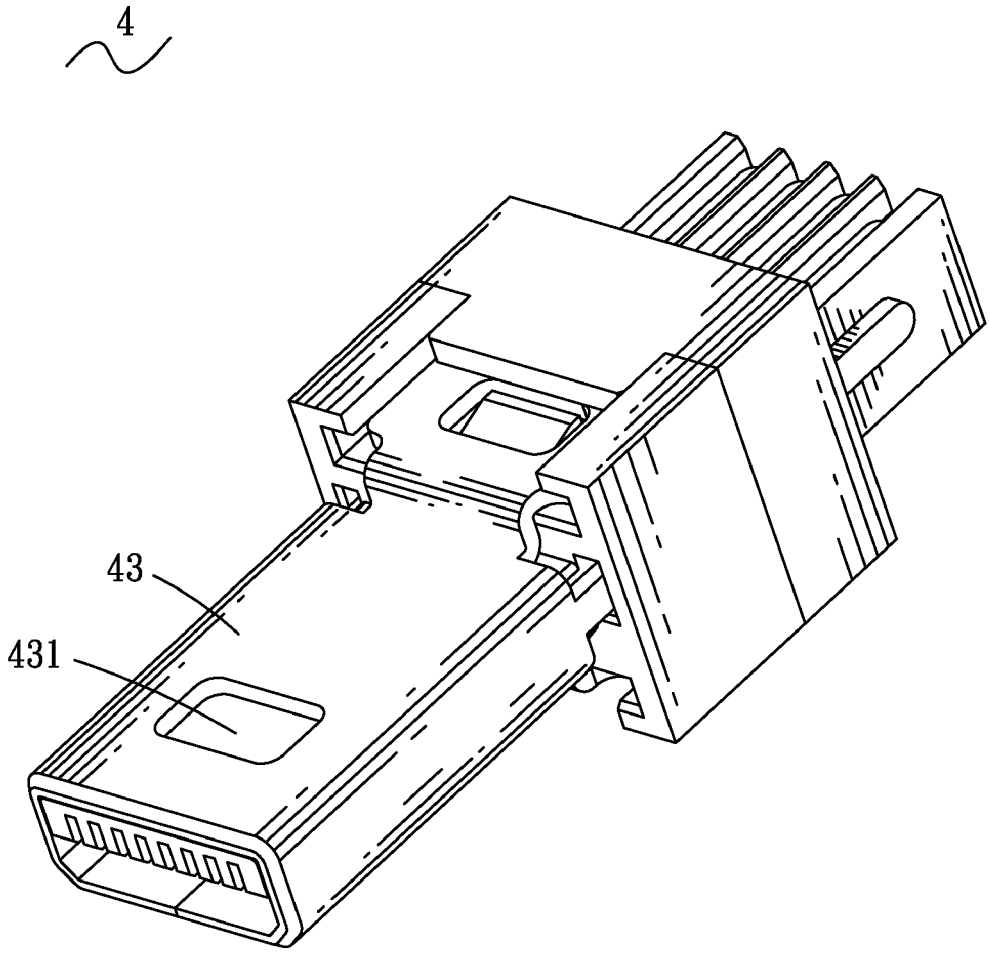
FIG. 7 is a perspective view of a mating electrical connector in accordance with the present invention.
Figure 8:
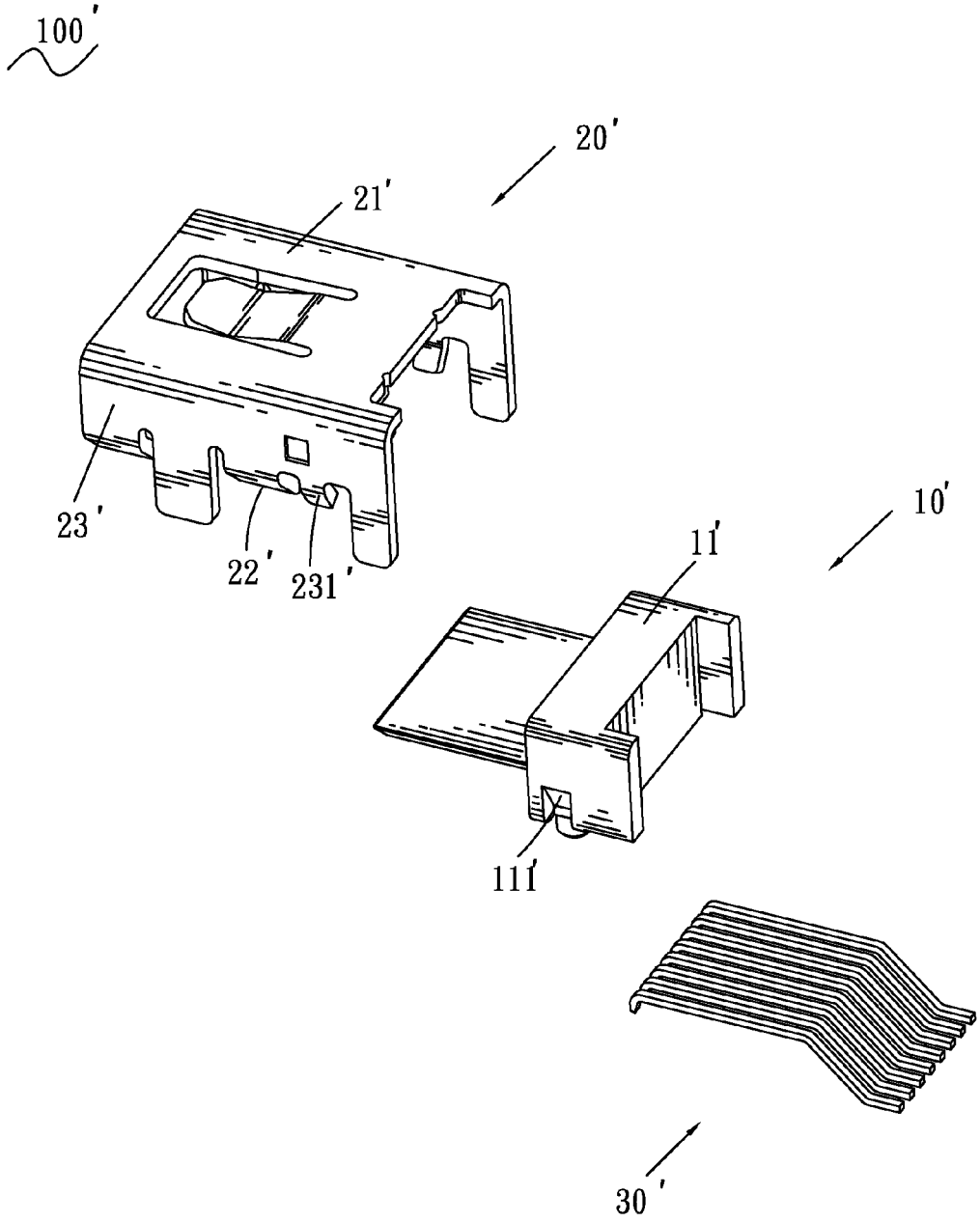
FIG. 8 PRIOR ART
FIG. 8 is a perspective view of an electrical connector in accordance with the teaching of the prior art.

As shown in FIGS. 4 and 5, the shield case 20 is formed with a top wall 21, a bottom wall 22 opposite to the top wall 21, two opposite side walls 23 connecting edge portions of the top wall 21 and the bottom wall 22, a front opening for allowing a mating electrical connector 4 (shown in FIG. 7) insert therefrom, an internal space 24 where the insulating housing 10 is incorporated formed inside the walls, and a rear stopper 27 extending rearward from a rear end of the top wall 21. The top wall 21 is flat and has a cantilever tongue piece 212 provided thereon. The cantilever tongue piece 212 has a rear base portion 213 and a front free end portion 214 which has a width narrower than that of the base portion 213. A curved portion 215 projects inside the shield case 20 at a substantially middle of the free end portion 214. And a rib 216 protrudes upward across the junction of the base portion 213 and the top wall 21 for strengthening the cantilever tongue piece 212. The side walls 23 attached to the corresponding side surfaces 110 of the base section 11 both have a cut portion 231 formed in two substantially corresponding portions thereof. An elastic locking piece 232 extends frontward and inclines inward from a rear edge of the cut portion 231. A rear mounting leg portion 26 extends downward from a rear of each side wall 23 adjacent to the cut portion 231. The bottom wall 22 has an inserting piece 28 extending rearward from a middle portion of a rear edge thereof.

When the mating electrical connector 4 enters the internal space 24 of the electrical connector 100, the curved portion 215 is pressed against a metal shroud 43 of the mating electrical connector 4 and caused to rise once outside the shield case 20 so as to mate with a depression 431 of the metal shroud 43. Consequently, the cantilever tongue piece 212 is allowed to bend with its wide base portion 213 as a fulcrum and strengthened by the rib 216.

Figure 6:
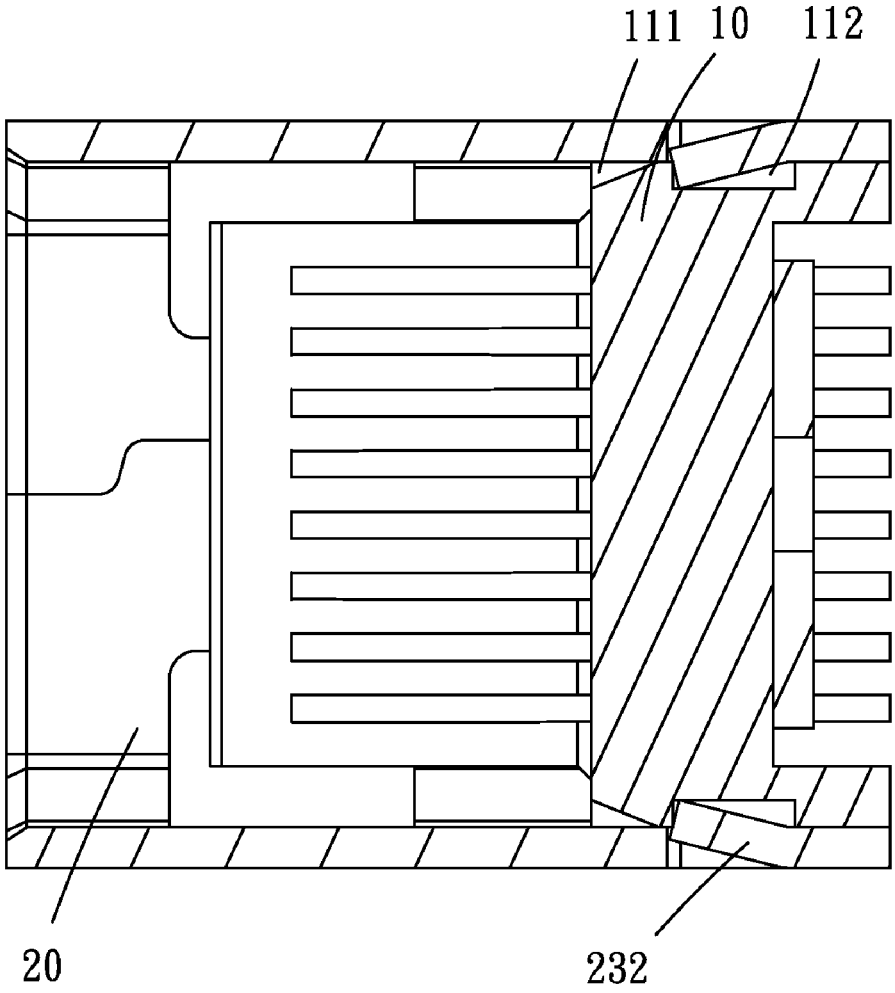
FIG. 6 is a cross-sectional view of the electrical connector in assembly.

Please refer to FIGS. 2 and 6, when the electrical connector 100 is assembled, the insulating housing 10 inserts into the internal space 24 of the shield case 20, a free end of the elastic locking piece 232 slides along the corresponding groove 111 and is gradually compressed outward and finally secured into the corresponding recess 112 by means of release thereof, the inserting piece 28 inserts into the gap 15 of the insulating housing 10 from the front of the gap 15. Then the rear stopper 27 is bent downward to fit into the indentation 13 of the insulating housing 10.

As described above, because the groove 111 is formed with a inclined bottom, the free end of the elastic locking piece 232 could slide along the corresponding groove 111 when the electrical connector 100 is assembled and finally secured into the recess 112 by means of release thereof. Therefore, the electrical connector can be easily assembled and also prevent the insulating housing from scratching in the process of assembly.

What is claimed is:

1. An electrical connector, comprising:

an insulating housing including a base section, two opposite side surfaces of the base section respectively defining a groove and a recess, the groove penetrating a front edge of the corresponding side surface and slanting outward gradually from a front edge to a rear edge thereof, the recess being located in rear of the groove, with a small space from the rear edge of the groove; and a shield case enclosing the insulating housing, the shield case including two opposite side walls attached to the corresponding side surfaces of the base section, a cut portion formed in two substantially corresponding portions of both of the side walls, an elastic locking piece extending frontward and inclining inward from a rear edge of the cut portion, wherein a free end of the elastic locking piece slides along the corresponding groove and is gradually compressed outward and finally secured into the corresponding recess by means of release thereof.

2. The electrical connector as claimed in claim 1, wherein the shield case includes a top wall connecting tops of the two side walls, a cantilever tongue piece is provided on the top wall, the cantilever tongue piece has a rear base portion and a front free end portion which has a width narrower than that of the base portion, a curved portion projects inside the shield case at a substantially middle of the free end portion.

3. The electrical connector as claimed in claim 2, wherein the shield case has a rib protruded upward across a junction of the base portion and the top wall for strengthening the cantilever tongue piece.

4. The electrical connector as claimed in claim 1, wherein the base section of the insulating housing has an indentation at a rear thereof, the shield case has a top wall, a rear stopper extending rearward from a rear end thereof, the rear stopper is bent downward to fit into the indentation when the electrical connector is assembled.

5. The electrical connector as claimed in claim 1, wherein a bottom of the base section of the insulating housing has a gap penetrating a front thereof, the shield case has a bottom wall connecting bottoms of the two side walls, a portion of a rear edge of the bottom wall extending rearward to form an inserting piece inserted into the gap from the front thereof.

* * * * *